US011214934B2

(12) United States Patent
Matthews et al.

(10) Patent No.: US 11,214,934 B2
(45) Date of Patent: Jan. 4, 2022

(54) SECURITY ARM BARRIER

(71) Applicant: B&B Roadway and Security Solutions, LLC, McKinney, TX (US)

(72) Inventors: Paul Matthews, Fairview, TX (US); Mark Ivey, Pearland, TX (US); Ron Johnson, Russellville, AL (US)

(73) Assignee: B & B Roadway and Security Solutions, LLC, McKinney, TX (US)

( * ) Notice: Subject to any disclaimer, the term of this patent is extended or adjusted under 35 U.S.C. 154(b) by 147 days.

(21) Appl. No.: 16/664,576

(22) Filed: Oct. 25, 2019

(65) Prior Publication Data

US 2021/0123197 A1 Apr. 29, 2021

(51) Int. Cl.

| | |
|---|---|
| ***E01F 13/00*** | (2006.01) |
| ***E01F 15/14*** | (2006.01) |
| ***E06B 11/02*** | (2006.01) |

(52) U.S. Cl.

CPC ..... *E01F 15/145* (2013.01); *E06B 11/027* (2013.01)

(58) Field of Classification Search

CPC ..... E01F 15/145; E06B 11/027
USPC ..... 49/49, 226, 232, 233, 234, 34
See application file for complete search history.

(56) References Cited

U.S. PATENT DOCUMENTS 1,628,651 A * 5/1927 Burress ..... B61L 29/02 49/9
4,364,200 A * 12/1982 Cobb ..... E01F 13/06 49/141
5,984,569 A * 11/1999 Chou ..... E01F 13/06 404/6
6,115,963 A * 9/2000 Allardyce ..... E01F 13/06 49/226
6,189,839 B1 * 2/2001 Lemieux ..... E01F 13/048 246/127
6,212,825 B1 * 4/2001 Hopkins, Jr. ..... B61L 29/04 49/29
6,796,084 B2 * 9/2004 Gagnon ..... E01F 13/06 49/226
7,384,017 B1 * 6/2008 Burke ..... B61L 29/04 246/125
7,814,706 B2 * 10/2010 Gamache ..... B61L 29/04 49/49
8,181,392 B1 * 5/2012 Farber ..... E01F 13/06 49/49
9,487,224 B1 * 11/2016 Pless ..... E06B 3/921
9,593,454 B2 * 3/2017 Burgin ..... B61L 29/04
(Continued)

FOREIGN PATENT DOCUMENTS

JP 05239981 A * 9/1993

*Primary Examiner* — Jerry E Redman
(74) *Attorney, Agent, or Firm* — McGuireWood LLP

(57) ABSTRACT

A variety of systems, methods, and compositions are disclosed, including in one method, a security arm barrier system, the system comprising: a drive stanchion mounted to a first substructure; an arm barrier coupled to the drive stanchion, wherein the arm barrier further comprises: a first member, wherein a proximal end of the first member is coupled to the drive stanchion; a second member, wherein a proximal end of the second member coupled to a distal end of the first member; and an articulating joint that couples the first member and the second member, and an energy absorbing material disposed within the first member and the second member; and a receiver stanchion mounted to a second substructure capable of receiving a distal end of the second member.

19 Claims, 3 Drawing Sheets

(56) References Cited

U.S. PATENT DOCUMENTS

| | | | | |
|---|---|---|---|---|
| 2002/0129552 | A1* | 9/2002 | Burke | E01F 13/06 49/49 |
| 2005/0139730 | A1* | 6/2005 | Zarkades | B61L 29/04 246/473.1 |
| 2021/0123197 | A1* | 4/2021 | Matthews | E06B 11/027 |

* cited by examiner

SECURITY ARM BARRIER

BACKGROUND

Conventional security arm barrier systems are designed to control traffic (vehicular or otherwise), while also deterring potential threats by vehicles to personnel and/or property. Security arm barrier systems may be configured to stop unwanted intruders from breaching a secure area are often used in association with key assets, such as, government installations, petrochemical facilities, parking garages, and other protected locations.

Currently, fortified barriers are capable of dissipating the momentum energy associated with impacts from moving masses. A standard barrier takes the momentum energy from the moving mass and transfers it to a foundation system. Various barrier designs dissipate momentum energy in excess of 1.2 million ft-lbs (15,000 lbs moving 50 mph) in a distance of less than 3.3 ft. Often these types of barriers are heavy steel structures requiring large foundations to hold in place. The energy is often dissipated in the crushing of the vehicle and absorption into barrier and foundation components. Drop arm barrier structures are increasingly difficult since the impacted arm structure must be capable of withstanding the impact and transferring the energy to side stanchions. Arms of this type are often metal structures with internal cables, chains, or straps (nylon, polyester, etc). The internal materials are heavy and do not bend freely. In addition to the structural aspects of the arm, often there are requirements for safety lighting, and other electrical sensors and warning devices requiring external conduits to protect the wiring.

BRIEF DESCRIPTION OF THE DRAWINGS

These drawings illustrate certain aspects of some of the present disclosure, and should not be used to limit or define the disclosure.

DETAILED DESCRIPTION

The present disclosure may be directed to providing arm barrier systems for use in protecting key assets. In an embodiment, a security arm barrier system may be configured to effectively stop large vehicles (e.g., medium duty trucks) and small vehicles (e.g., passenger cars) from crashing through the assembly and breaching the area being protected by the barrier assembly. In an embodiment, a security arm barrier system may be provided for allowing a vehicle to pass there through, wherein the vehicle may comprise a frame, a body, and a windshield. While the present disclosure depicts systems and methods of a security arm barrier system in a parking structure, it should be noted that security arm barrier system may be used in a wide variety of applications and should not be limited herein. The security arm barrier system may be described in more detail below.

Figure 1A:
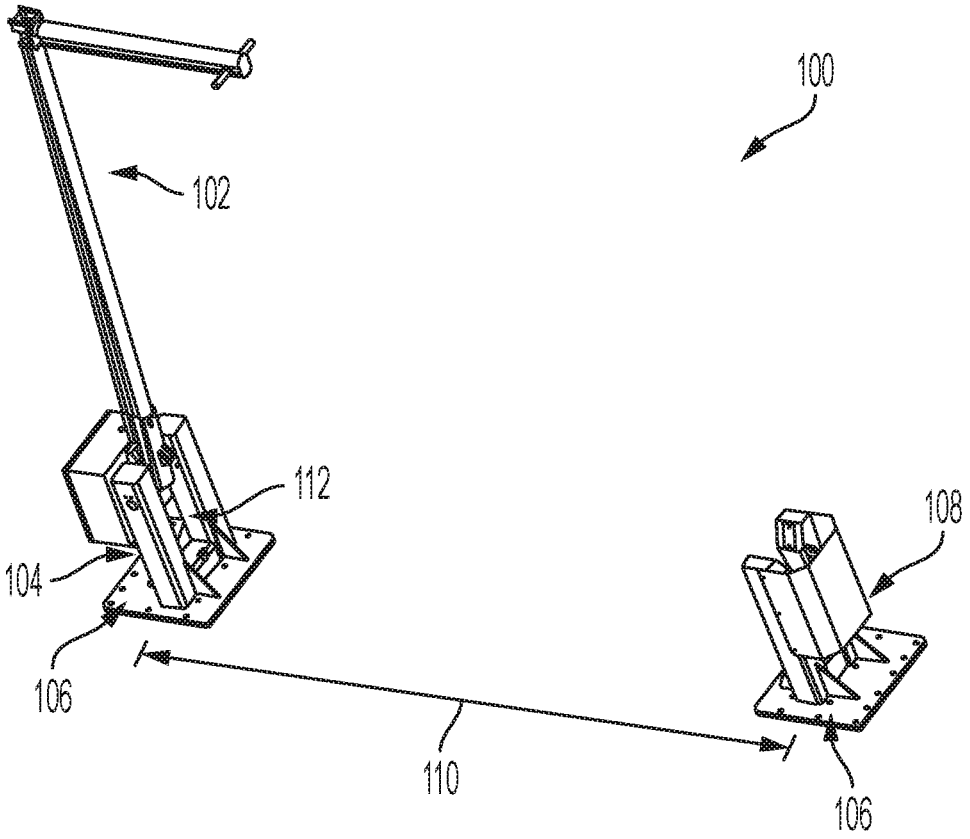
FIG. 1A illustrates an embodiment of a security arm barrier in a stowed position.
Figure 1B:
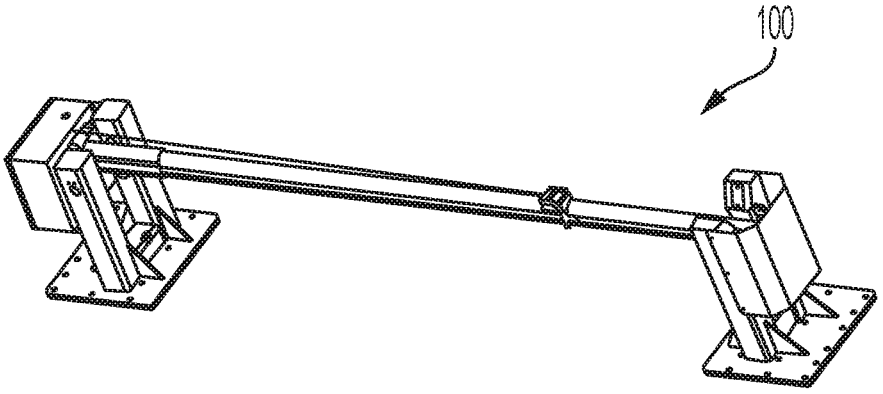
FIG. 1B illustrates an embodiment of a security arm barrier in a deployed position.

FIGS. 1A and 1B illustrate an embodiment of a security arm barrier system 100. Security arm barrier system 100 may comprise a drive stanchion 104, an arm barrier 102, and a receiver stanchion 108. Drive stanchion 104 may be disposed adjacent to receiver stanchion 108 at a distance 110. Distance 110 may be any suitable distance capable of allowing a motor vehicle (not shown) to pass there through. In certain embodiments, security arm barrier system 100 may be disposed within any suitable permanent or semi-permanent structure including, but not limited to, a parking garage, the like, or any combinations thereof. In certain embodiments, drive stanchion 104 and receiver stanchion 108 may be mounted directly to a surface or a subsurface of the permanent structure. In a non-limiting example, a suitable surface or subsurface of the permanent or semi-permanent structure may include the floor, the ceiling, the walls, the like, or any combinations thereof. In certain embodiments, drive stanchion 104 and receiver stanchion 108 may be mounted to secure substructure 106 which may provide additional stability to security arm barrier system 100. Suitable secure substructures 106 may include, but are not limited to, reinforced cement mounting pads, the like, or any combinations thereof.

Security arm barrier system 100 may further comprise a drive system 112. Any suitable drive system 112 capable of pivotally raising and lowering arm barrier 102 may be used. Suitable drive system 112 may include, but is not limited to, a hydraulic system, an electric actuator system, a manual actuator system, a mechanical actuator system, a gas spring actuator system, the like, or any combinations thereof. Drive system 112 may be disposed in any suitable location within security arm barrier system 100 and should not be limited herein. In certain embodiments, hydraulic system 112 may be disposed within drive stanchion 104.

In non-limiting example, a proximal end of arm barrier 102 may project into the drive stanchion 104. Cooperating with the proximal end of arm barrier 102 may be a lifting boom (not shown) which may engage the arm barrier 102 by means of any suitable boom roller support (not shown), which may affect a rolling motion between the proximal end of arm barrier 102 and the lifting boom. The drive system may further comprise one or more drive actuators and respective operating rods that may be connected between the lifting boom and respective actuator mounting brackets. In an embodiment, the drive system may comprise one actuator may be sufficient to raise and lower the arm barrier. In an embodiment, the drive system may comprise two co-acting actuators. One actuator may be positioned such that it is in the pushing mode while the other actuator may operate concurrently therewith in the drawing mode. The one or more actuators may be in any suitable position capable of raising and lowering arm barrier 102 and should not be limited herein.

Arm barrier system 100 may further comprise a control unit (not shown). The control unit may be interconnected with operating signal receiving equipment (not shown). Any number of operating systems may be utilized and should not be limited herein. In certain embodiments, the control system may comprise a hydraulic pumping unit, an electrical power unit, the like, and any combinations thereof. In certain embodiments, the control unit may be mounted to on the drive stanchion 104 or at any suitable location on or near arm barrier system 100.

FIG. 1A illustrates an embodiment of a security arm barrier system 100 in a stowed position. As used herein, "stowed position" may also be referred to as a "raised position." The security arm barrier system 100 may be placed in a stowed position when it may be desired to allow a vehicle to pass through the security arm barrier system 100.

FIG. 1B illustrates an embodiment of a security arm barrier system 100 in a deployed position. As used herein, a "deployed position" may also be referred to as a security arm barrier system 100 in a lowered position. When the security arm barrier system 100 may be deployed, the arm barrier 102 may be fully extended from the drive stanchion 104 to the receiver stanchion 108. In an embodiment, the arm barrier 102 may be substantially horizontal relative to the surface in which the drive stanchion 104 and the receiver stanchion 108 may be mounted thereon. When deployed, arm barrier 102 may be capable of blocking motor vehicles or the like from passing there through. In an embodiment, the deployed arm barrier system 100 may be capable of stopping a vehicle weighing up to about 65,000 lbs (about 29,500 kg), travelling at a speed of up to about 50 mph (about 22 m/s).

Figure 2:
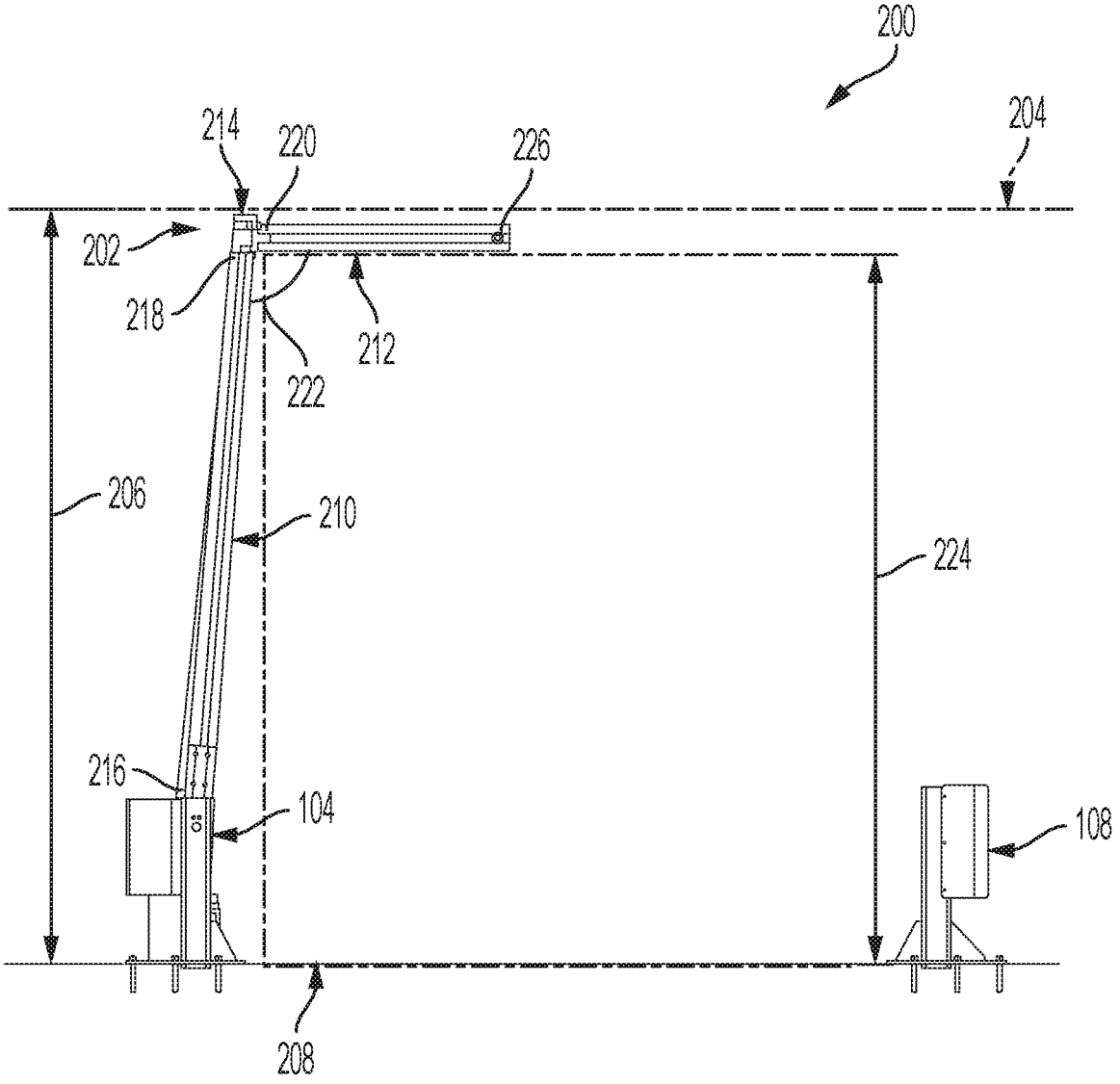
FIG. 2 illustrates an embodiment of a security arm barrier system deployed within a permanent or semi-permanent structure.

FIG. 2 illustrates an embodiment of a security arm barrier system disposed within a permanent or semi-permanent structure 200. The security arm barrier system disposed within a permanent structure 200 may comprise an arm barrier 202. Arm barrier 202 may be vertically limited by an upper surface 204 of the permanent or semi-permanent structure. Said vertical limitations may inadvertently impose limitations on the length of arm barrier 202 and consequently the distance between drive stanchion 104 and receiver stanchion 108. The arm barrier 202 may be constructed to maximize the length of arm barrier 202 while complying with the vertical limitations (i.e., maximum height 206 of the permanent or semi-permanent structure, wherein the maximum height 206 is measured from a bottom surface 208 to upper surface 204.) that may be imposed by the permanent structure.

Arm barrier 202 may comprise a first member 210, a second member 212, and an articulating joint 214. In certain embodiments, a proximal end of first member 216 may project into drive stanchion 104 and may be coupled therein in any suitable manner. Articulating joint 214 may pivotally connect first member 210 to second member 212 without interfering with an energy absorbing system disposed within arm barrier 202. In certain embodiments, articulating joint 214 may be disposed at a distal end of first member 218 and a proximal end of second member 220. Any suitable articulating joint 214 may be used including, but not limited to, a ball and socket joint, a hinge joint, a condyloid joint, a pivot joint, a gliding joint, a saddle joint, the like, and/or any combinations thereof. In certain embodiments, articulating joint 214 may Articulating joint 214 may be capable of pivotally connecting first member 210 and second member 212 such that, when arm barrier 202 is stowed the first member 210 and second member 212 form angle 222, and when arm barrier 202 is deployed first member 210 and second member 212 are in the same plane fully extending from drive stanchion 104 to receiver stanchion 108. In certain embodiments, arm barrier 202 may further comprise a non-powered linkage system to aid in providing angle 222 when arm barrier 202 is in a stowed position. Angle 222 may be any suitable angle capable of providing arm barrier 202 with a maximum raised height 224 that is less than the maximum height 206 of the permanent or semi-permanent structure. Maximum raised height may be measured from bottom surface 208 to second member 212. In certain embodiments, a powered linkage system may be used to aid in providing angle 222. In certain embodiments, articulating joint 214 may not interfere with the energy absorbing material (not shown) disposed within the arm barrier 202.

First member 210 and second member 212 may be of any suitable length such that when the arm barrier 202 is deployed, it may fully extend from the drive stanchion 104 to receiver stanchion 108. In an embodiment, the arm barrier 202 may be formed to have a length of about 6 feet to about 40 feet, or any values or range of values therein. In an embodiment, first member 210 and second member 212 may comprise different lengths. In an embodiment, the length of first member 210 may be greater than the length of second member 212.

Figure 3B:
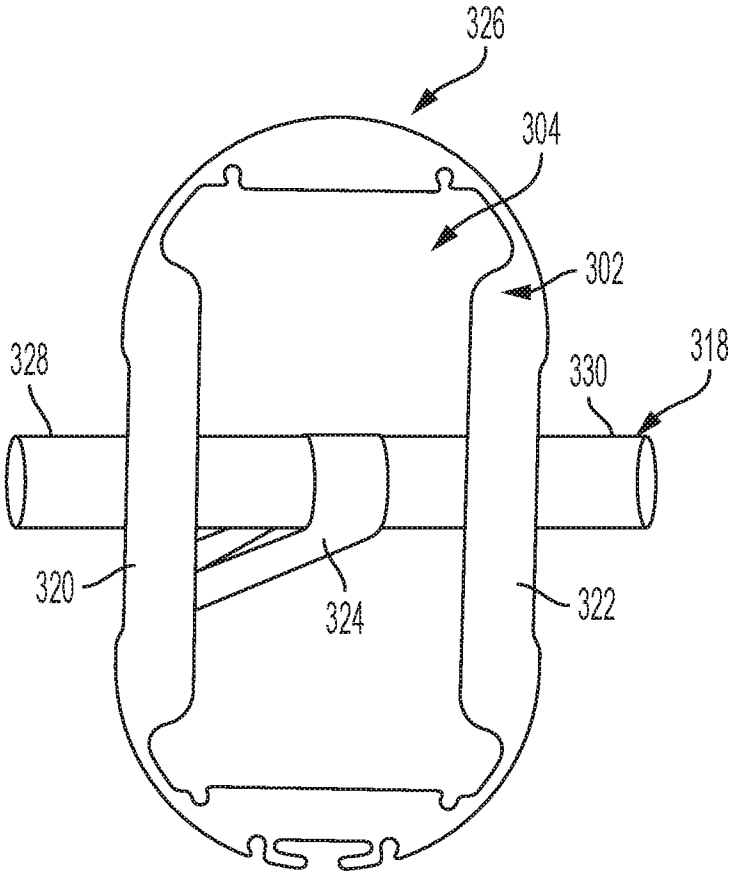
FIG. 3B illustrates an embodiment of an area of a distal end of the arm barrier capable of locking into a receiver stanchion.
Figure 3A:
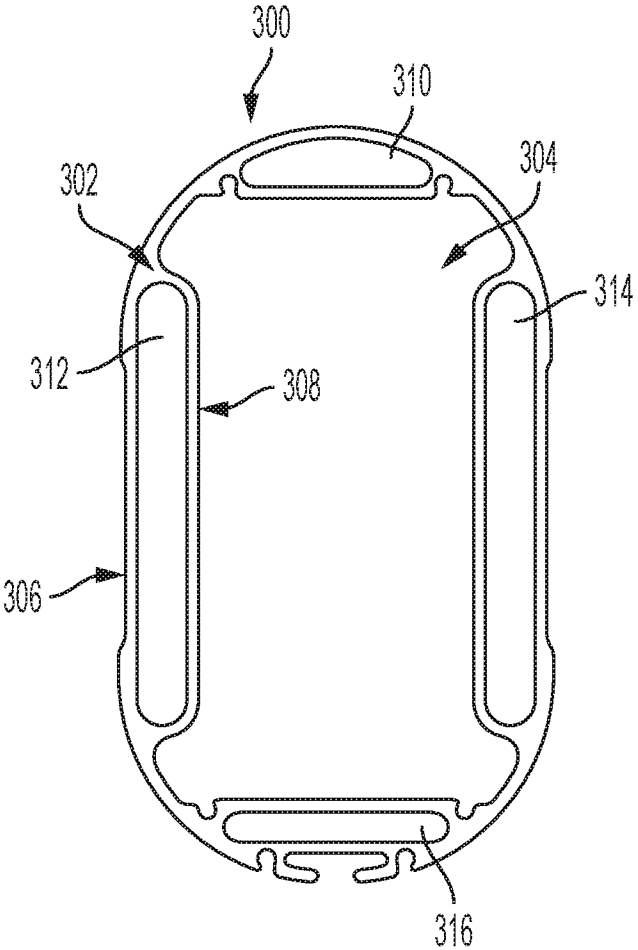
FIG. 3A illustrates an embodiment of an area of the arm barrier.

FIG. 3A illustrates an embodiment of an cross-sectional area of a member of arm barrier 300. Arm barrier 300 may be of any suitable form capable of housing an energy absorbing system (not shown). In certain embodiments, arm barrier 300 may be hollow or partially hollow in form. Arm barrier 300 may be formed using any suitable method and should not be limited herein. Suitable methods may include, but are not limited to, extrusion, pultrusion, the like, or any combinations thereof. Arm barrier 300 may be formed using any suitable material capable of be extruded and/or pultruded. Suitable materials may include, but are not limited to, aluminum, fiberglass, the like, or any combinations thereof. In certain embodiments, the material may be a light weight material. As used herein, "light weight material" may refer to any material capable of providing an arm barrier 300 with a weight of about 5.00 lbs/ft or less. In certain embodiments, the weight of the light weight material may be directly related to the length of the arm. In a non-limiting example, as the length of the arm barrier increases, the weight of the light weight material may also increase.

In a non-limiting example, arm barrier 300 may be extruded thereby providing a wall 302 and an internal cavity 304. In certain embodiments, internal cavity 304 may be a hollow channel extending through the entire length of arm barrier 102. Internal cavity 304 may be formed to have any suitable cross-section capable of housing an energy absorbing system (not shown) including, but not limited to, square, circle, triangle, rectangle, scalene, pentagon, right triangle, trapeze, kite, polygon, parallelogram, ellipse, trefoil, star, semicircle, hexagon, heptagon, octagon, decagon, dodecagon, crescent, octagon, cross, oval, heart, quatrefoil, rhombus, the like, or any combinations thereof.

Arm barrier 300 may be formed to further comprise a conduit or a plurality of conduits 310, 312, 314, 316 disposed within a wall 302 of arm barrier 300. Conduit 310, 312, 314, 316 may be disposed within wall 302 between an external surface 306 and an internal surface 308. Each conduit 310, 312, 314, 316, may be formed to have any suitable cross-section capable of protecting and/or housing elements necessary for operating a security arm barrier system. Suitable cross-sections may include, but are not limited to, square, circle, triangle, rectangle, scalene, pentagon, right triangle, trapeze, kite, polygon, parallelogram, ellipse, trefoil, star, semicircle, hexagon, heptagon, octagon, decagon, dodecagon, crescent, octagon, cross, oval, heart, quatrefoil, rhombus, the like, or any combinations thereof. In certain embodiments, conduit 310, 312, 314, 316 may house elements such as wires, heating/cooling elements, chains, cables, hoses, the like, or any combinations thereof. In a non-limiting example, conduit 310 may house an internal heating element thereby providing a system that may remove ice and/or snow from the arm during operation. In certain embodiments, the external surface area of arm barrier 300 may be maximized to provide surface visibility for safety and may act as an increased visible deterrent.

FIG. 3B illustrates an embodiment of an cross-sectional area of a distal end of a second member of arm barrier 326 barrier similar to the second member 212 of arm barrier 202 illustrated in FIG. 2 and capable of locking into a receiver stanchion (not shown). Distal end of arm barrier 326 may comprise a locking pin 318. Locking pin 318 may extend through a first side 320 of wall 302, through internal cavity 304, and through a second side 322 of wall 302. At least a portion 328 of locking pin 318 may protrude from the first side 320 of wall 302 and at least a portion 330 of locking pin 318 may protrude from the second side 322 of wall 302. In certain embodiments, wall 302 may comprise a conduit or a plurality of conduits (referring to FIG. 3A) disposed through which locking pin 318 may extend.

In certain embodiments, an energy absorbing material 324 may be disposed circumferentially about at least a portion of locking pin 318 within internal cavity 304. Energy absorbing material 324 may extend from locking pin 318 through internal cavity 304 and into a drive stanchion and at least partially disposed circumferentially about a drive shaft (not shown).

In certain embodiments, energy absorbing material 324 may be configured to provide a requisite stopping force in the event a motor vehicle, intentionally or accidentally, crashes into an arm barrier system. In a non-limiting example, as a motor vehicle (not shown) crashes into an arm barrier system, the wall 302 may deform and tension may be applied to energy absorbing material 324. In certain embodiments, the energy absorbing material 324 may be capable of bending upon impact of a motor vehicle (not shown). Locking pin 318 may be forced towards a receiver stanchion (not shown) where it may lock into place. The energy absorbing material 324 may then prevent the motor vehicle from pass through the arm barrier system. In certain embodiments, additional locking mechanisms may be included in the system and should not be limited herein. In certain embodiments, the energy absorbing material and the arm barrier system may absorb the kinetic energy produced by a motor vehicle and may then dissipate said kinetic energy to a drive stanchion and a receiver stanchion.

Energy absorbing material 324 may be any suitable energy absorbing material 324 capable of providing a stopping energy of up to about 2,000,000 kft-lbs. The energy absorbing material 324 may be a rope. Any suitable rope may be used and should not be limited herein. The rope may comprise any suitable material. Suitable material may include, but is not limited to, aromatic copolyamide, aramid fiber, a copolyparaphenylene-3,4'-oxydiphenylene terephthalamide, aromatic nylons, poly(p-phenylene terephthalamide), poly (m-phenylenediamine isophthalamide), ultra-high molecular weight polyethylene, the like, and/or any combinations thereof. The rope may also be fabricated with a metal fiber such as stainless steel, aluminum, the like, or any combinations thereof. The rope may comprise any suitable number of cords for a given application and should not be limited herein. The cords may be configured in any suitable arrangement and should not be limited herein. The number of ropes present in the arm barrier 300, 326 may determine the amount of energy the arm barrier system is capable of stopping. Any suitable number of ropes may be used for a given application and should not be limited herein.

In an embodiment, the energy absorbing system may comprise any suitable tensile strength. As used herein, tensile strength may refer to the energy absorbing systems resistance to rupture under tension. In an embodiment, the energy absorbing system may comprise a tensile strength of about 18 g/denier to about 30 g/denier, or about 18 g/denier to about 26 g/denier, or about 26 g/denier to about 30 g/denier, or any value or range of values therein. Tensile strength may be tested according to ASTM D7269/D7269M, *Standard Test Methods for Tensile Testing of Aramid Yarns*, ASTM International, West Conshohocken, Pa., 2017.

In an embodiment, energy absorbing material 324 may comprise any suitable ultimate elongation. Ultimate elongation, as used herein, may refer to the energy absorbing material's ability to stretch without breaking. Ultimate elongation of the energy absorbing material 324 may be expressed as percent of original length at the moment of breaking. Ultimate elongation of the energy absorbing material 324 may be determined according to ASTM D885-85, *Standard Test Methods for Tire Cords, Tire Cord Fabrics, and Industrial Filament Yarns Made from Manufactured Organic-Base Fibers*, ASTM International, West Conshohocken, Pa. 2014. In certain embodiments, suitable ultimate elongation of energy absorbing material 324 may include, but is not limited to, about 1% to about 500%, or about 500% to about 1,000%, or any value or range of values therein. The energy absorbing material 324 may be selected to have any ultimate elongation for a given application and should not be limited.

In an embodiment, the energy absorbing system may comprise any suitable melting point for a given application. As used herein, "melting point" may refer to the temperature at which the energy absorbing system may undergo phase change from a solid. In an embodiment, the energy absorbing system may comprise a melting point of about 500° C. or greater. Melting point may be tested according to ASTM D276, *Standard Test Methods for Identification of Fibers in Textiles*, ASTM International, West Conshohocken, Pa., 2012.

In certain embodiments, the energy absorbing material 324 may comprise a variety of other characteristics that may aid in environmental longevity. Other characteristics may include, but are not limited to, rodent resistant, corrosion resistant, UV light resistant, cold resistant, the like, or any combinations thereof.

Accordingly, this disclosure describes methods, systems, and apparatuses that may use the disclosed security arm barrier system. The methods, systems, and apparatuses may include any of the following statements:

Statement 1: A security arm barrier system, the system comprising: a drive stanchion mounted to a first substructure; an arm barrier coupled to the drive stanchion, wherein the arm barrier further comprises: a first member, wherein a proximal end of the first member is coupled to the drive stanchion; a second member, wherein a proximal end of the second member coupled to a distal end of the first member; and an articulating joint that couples the first member and the second member, and an energy absorbing material disposed within the first member and the second member; and a receiver stanchion mounted to a second substructure capable of receiving a distal end of the second member.

Statement 2: The security arm barrier system of statement 1, wherein the arm barrier further comprises a linkage system.

Statement 3: The security arm barrier system of statement 1 or 2, wherein the articulating joint and the linkage system raise and lower the arm barrier, wherein the articulating joint and the linkage system provide an angle between the first member and the second member when the arm barrier is in a raised position.

Statement 4: The security arm barrier system of any of the preceding statements, wherein the linkage system operates using gravity.

Statement 5: The security arm barrier system of any of the preceding statements, wherein the first member and the second member are formed by extrusion or pultrusion.

Statement 6: The security arm barrier system of any of the preceding statements, wherein the first member and the second member further comprise: a wall, an internal cavity comprising the energy absorbing material, and an at least one conduit disposed within the wall between an outer surface of the first member and the second member and the internal cavity.

Statement 7: The security arm barrier system of any of the preceding statements, wherein the at least one conduit comprises at least one element select from the group consisting of a wire, an internal heating element, an internal cooling element, a chain, and any combinations thereof.

Statement 8: The security arm barrier system of any of the preceding statements, wherein a length of the first member is greater than a length of the second member.

Statement 9: The security arm barrier system of any of the preceding statements, wherein the distal end of the second member further comprises a locking pin, wherein the locking pin extends through a first side of the wall, through the internal cavity and through a second side of the wall.

Statement 10: The security arm barrier system of any of the preceding statements, wherein at least a portion of the locking pin protrudes from the first side of the wall and the second side of the wall.

Statement 11: The security arm barrier system of any of the preceding statements, wherein the locking pin is capable of locking the arm barrier within a locking system disposed within the receiver stanchion.

Statement 12: The security arm barrier system of any of the preceding statements, wherein the energy absorbing material is capable of providing a stopping energy of up to about 2,000,000 kft-lbs or less.

Statement 13: The security arm barrier system of any of the preceding statements, wherein the energy absorbing material comprises at least one material selected from the group consisting of aromatic copolyamide, aramid fiber, a copolyparaphenylene-3,4'-oxydiphenylene terephthalamide, aromatic nylons, poly(p-phenylene terephthalamide), poly (m-phenylenediamine isophthalamide), ultra-high molecular weight polyethylene, and any combinations thereof.

Statement 14: The security arm barrier system of claim 1, wherein the drive stanchion further comprises: a hydraulic system disposed within a body of the drive stanchion capable of actuating the arm barrier; and a control system disposed within the body of the drive stanchion capable of actuating the hydraulic system.

Statement 15: A method for monitoring motor vehicles entering a location using a security arm barrier system, the method comprising: deploying an arm barrier to extend from a drive stanchion to a receiver stanchion thereby preventing motor vehicles from passing therethrough, wherein the arm barrier comprises: a first member, wherein a proximal end of the first member is coupled to the drive stanchion; a second member, wherein a proximal end of the second member coupled to a distal end of the first member; and an articulating joint that couples the first member and the second member, and an energy absorbing material disposed within the first member and the second member; crashing the motor vehicle into the arm barrier; and stopping the motor vehicle upon impact.

Statement 16: The method of statement 15, The security arm barrier system of claim 1, wherein the energy absorbing system is capable of providing a stopping energy of up to about 2,000,000 kft-lbs or less.

Statement 17: The method of statement 15 or 16, wherein the first member and the second member further comprise: a wall, an internal cavity comprising the energy absorbing material, and an at least one conduit disposed within the wall between an outer surface of the first member and the second member and the internal cavity.

Statement 18: The method of any of statements 15 to 17, wherein a distal end of the second member further comprises a locking pin, wherein at least a portion of the energy absorbing material is disposed circumferentially about the locking pin thereby extending through the internal cavity and into the drive stanchion, wherein at least a portion of the energy absorbing material is disposed circumferentially about a drive shaft within the drive stanchion.

Statement 19: The method of any of statements 15 to 18, wherein the energy absorbing material provides tension to the security arm barrier system upon impact of the motor vehicle thereby pulling the locking pin towards the receiver stanchion and into a locking mechanism.

Statement 20: The method of any of statements 15 to 19, wherein the wall of the first member and the second member are deformed upon impact of the motor vehicle, wherein the energy absorbing material bends upon impact of the motor vehicle.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular examples disclosed above are illustrative only, as the present disclosure may be modified and practiced in different but equivalent manners apparent to those skilled in the art having the benefit of the teachings herein. Although individual examples are discussed, the disclosure covers all combinations of all those examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A security arm barrier system, the system comprising:
a drive stanchion mounted to a first substructure;
an arm barrier coupled to the drive stanchion, wherein the arm barrier further comprises:
a first member, wherein a proximal end of the first member is coupled to the drive stanchion;
a second member, wherein a proximal end of the second member coupled to a distal end of the first member; and
an articulating joint that couples the first member and the second member, and
an energy absorbing material disposed within the first member and the second member; and
a receiver stanchion mounted to a second substructure capable of receiving a distal end of the second member,
wherein the distal end of the second member further comprises a locking pin, wherein the locking pin extends through a first side of a wall, through the internal cavity and through a second side of the wall.

2. The security arm barrier system of claim 1, wherein the arm barrier further comprises a linkage system.

3. The security arm barrier system of claim 2, wherein the articulating joint and the linkage system raise and lower the arm barrier, wherein the articulating joint and the linkage system provide an angle between the first member and the second member when the arm barrier is in a raised position.

4. The security arm barrier system of claim 2, wherein the linkage system operates using gravity.

5. The security arm barrier system of claim 2, wherein a length of the first member is greater than a length of the second member.

6. The security arm barrier system of claim 1, wherein the first member and the second member are formed by extrusion or pultrusion.

7. The security arm barrier system of claim 1, wherein the first member and the second member further comprise:
a wall,
an internal cavity comprising the energy absorbing material, and
an at least one conduit disposed within the wall between an outer surface of the first member and the second member and the internal cavity.

8. The security arm barrier system of claim 7, wherein the at least one conduit comprises at least one of a wire, an internal heating element, an internal cooling element, and a chain.

9. The security arm barrier system of claim 1, wherein at least a portion of the locking pin protrudes from the first side of the wall and the second side of the wall.

10. The security arm barrier system of claim 1, wherein the locking pin is capable of locking the arm barrier within a locking system disposed within the receiver stanchion.

11. The security arm barrier system of claim 1, wherein the energy absorbing material is capable of providing a stopping energy of up to about 2,000,000 kft-lbs or less.

12. The security arm barrier system of claim 1, wherein the energy absorbing material comprises at least one of aromatic copolyamide, aramid fiber, a copolyparaphenylene-3,4'-oxydiphenylene terephthalamide, aromatic nylons, poly(p-phenylene terephthalamide), poly (m-phenylenediamine isophthalamide), and ultra-high molecular weight polyethylene.

13. The security arm barrier system of claim 1, wherein the drive stanchion further comprises:
a hydraulic system disposed within a body of the drive stanchion capable of actuating the arm barrier; and
a control system disposed within the body of the drive stanchion capable of actuating the hydraulic system.

14. A method for monitoring motor vehicles entering a location using a security arm barrier system, the method comprising:
deploying an arm barrier to extend from a drive stanchion to a receiver stanchion thereby preventing motor vehicles from passing therethrough, wherein the arm barrier comprises:
a first member, wherein a proximal end of the first member is coupled to the drive stanchion;
a second member, wherein a proximal end of the second member coupled to a distal end of the first member; and
an articulating joint that couples the first member and the second member, and
an energy absorbing material disposed within the first member and the second member;
crashing the motor vehicle into the arm barrier; and
stopping the motor vehicle upon impact,
wherein a distal end of the second member further comprises a locking pin, wherein at least a portion of the energy absorbing material is disposed circumferentially about the locking pin thereby extending through the internal cavity and into the drive stanchion.

15. The method of claim 14, wherein the energy absorbing system is capable of providing a stopping energy of up to about 2,000,000 kft-lbs or less.

16. The method of claim 14, wherein the first member and the second member further comprise:
a wall,
an internal cavity comprising the energy absorbing material, and
an at least one conduit disposed within the wall between an outer surface of the first member and the second member and the internal cavity.

17. The method of claim 14, wherein at least a portion of the energy absorbing material is disposed circumferentially about a drive shaft within the drive stanchion.

18. The method of claim 14, wherein the energy absorbing material provides tension to the security arm barrier system upon impact of the motor vehicle thereby pulling the locking pin towards the receiver stanchion and into a locking mechanism.

19. The method of claim 14, wherein the wall of the first member and the second member are deformed upon impact of the motor vehicle, wherein the energy absorbing material bends upon impact of the motor vehicle.

* * * * *